United States Patent [19]

Altherr

[11] Patent Number: 4,605,133

[45] Date of Patent: Aug. 12, 1986

[54] COUPLER KNUCKLE

[75] Inventor: Russell G. Altherr, Munster, Ind.

[73] Assignee: Amsted Industries Incorporated, Chicago, Ill.

[21] Appl. No.: 534,814

[22] Filed: Sep. 22, 1983

[51] Int. Cl.[4] ..... B61G 3/04

[52] U.S. Cl. ..... 213/155; 213/109

[58] Field of Search ..... 213/139, 115, 145, 146, 213/147, 148, 155, 154, 153, 109

[56] References Cited

U.S. PATENT DOCUMENTS 461,312 10/1891 Brown ..... 213/155
533,985 2/1895 Brown ..... 213/155
693,998 2/1902 Brown ..... 213/148
2,689,051 9/1954 Kayler ..... 213/146

FOREIGN PATENT DOCUMENTS 537219 2/1957 Canada ..... 213/155
540837 5/1957 Canada ..... 213/155

*Primary Examiner*—Robert B. Reeves
*Assistant Examiner*—Dennis C. Rodgers
*Attorney, Agent, or Firm*—Edward J. Brosius; Charles E. Bouton

[57] ABSTRACT

A coupler knuckle made from cast metal and having cored sections providing exterior walls adjacent the location subject to stress in use. These wall sections are formed in such a manner as to withstand the stresses.

1 Claim, 4 Drawing Figures

COUPLER KNUCKLE

FIELD OF THE INVENTION

The present invention relates to railway vehicle couplers and more particularly to an improved knuckle.

PRIOR ART

Couplers used to couple railway vehicles are of well known construction including generally a coupler body having a shank and a coupler head. The coupler head includes a generally V-shaped jaw defined by a guard arm side and a knuckle side. A knuckle is pivotally connected to the knuckle side and is arranged to coact with a mating coupler to interlock with the knuckle of the latter. Suitable locking means for holding the mating knuckles locked in their respective couplers and releasing means for releasing the knuckles are provided.

The knuckles are subject to severe usage and wear conditions and are constructed so as to withstand such usage and wear without fatigue failure or distortion of the coupler. Knuckles are usually made of cast metal such as steel and in order to maintain the weight at a reasonable level it is common practice to core the interior.

The knuckle casting generally is formed with exterior surfaces provided with draft in order to facilitate removal from the mold. Some of these draft surfaces have resulted in forming a wall having a wall contour creating localized and concentrated stresses tending to cause failure.

SUMMARY OF THE INVENTION

By the present invention it is proposed to provide a cast coupler knuckle having greater wear characteristics than heretofore while simultaneously maintaining the weight of the knuckle at a minimum.

It is an object of the present invention to provide a knuckle with an improved lock face section which is more resistant to the stresses imposed thereon than heretofore.

It is another object to provide a knuckle with a pulling face section which is formed by a wall of improved contour and greater strength.

It is still a further object of the invention to provide knuckles having a throat wall having greater resistance to fatigue than heretofore.

The foregoing and other objects which will hereinafter become apparent are accomplished by a knuckle comprising generally a metal casting formed to provide a locking face surface, a heel, a tail, a knuckle pin opening and a forward portion including a pulling face spaced inwardly from the outer surface of forward portion, and a throat surface spaced laterally from the pin hole.

The locking face surface is provided on the outer surface of a wall having an inner surface from which there extends a substantially perpendicular reinforcing web defined by a wall formed in the tail. The web terminates at an edge of an opening in the end wall of the tail so as to extend from said locking face at least two multiples of thickness of the locking face wall.

The intermediate portion of the pin hole opposing the throat is formed with an irregular surface so as to provide a wall of substantially uniform cross sectional area, and which is a thickness capable of withstanding the stresses imposed thereon without fatigue.

To further enhance the strength the forward portion of the knuckle is cored so that the thickness of the wall forming the pulling face is at least one-third of the distance between the pulling face and the outer surface of the forward portion.

Moreover, the leading wall face of the forward portion is maintained substantially normal to the longitudinal center line of the knuckle so as to maintain a substantially uniform wall thickness at the cored areas.

DESCRIPTION OF THE PREFERRED EMBODIMENT

Figure 2:
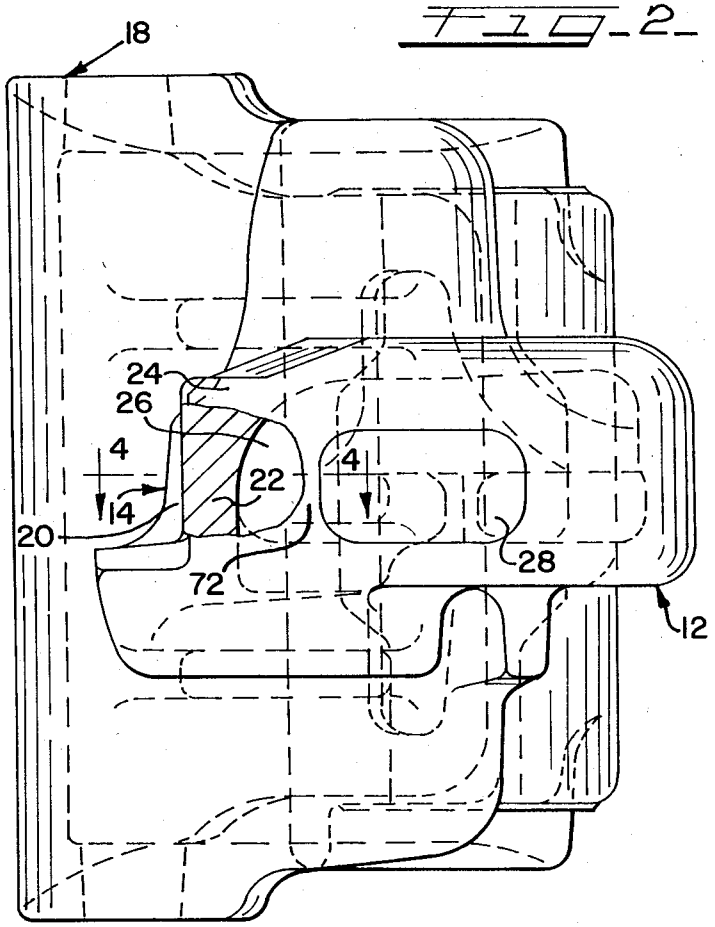
FIG. 2 is an elevational view of the coupler taken along the lines 2—2 of FIG. 1 and with some of the parts being broken away to show underlying details of structure.

Referring now to the drawings there is shown a knuckle 10 embodying the structure of the present invention. The knuckle 10 is formed as a steel casting and comprises generally a rear portion or tail 12, an intermediate portion 14 provided with a pin hole 16 and a forward portion 18. The knuckle is further shown in relationship to a coupler center line C when it is mounted on the coupler by a pin extending through the pin hole 16.

The rear portion 12 includes a substantially vertical locking face 20 formed on wall 22 which is generally normal to a rear wall 24. The inner surfaces of the wall 22 and the rear wall are defined by a cavity 26 which is formed in the rear portion 12.

The locking face wall 22 coacts with the coupler lock of the AAR standard E Coupler in the well known manner. The wall 22 is frequently subject to forces tending to crush or distort it. By the present invention the wall 22 is reinforced by web portion 72 of rear wall 24 which extends to lighten hole 28. The length of the web is at least twice the thickness of the locking face wall 22. In this manner the web 72 serves to reinforce the wall and render it more resistant to crushing during use.

Figure 1:
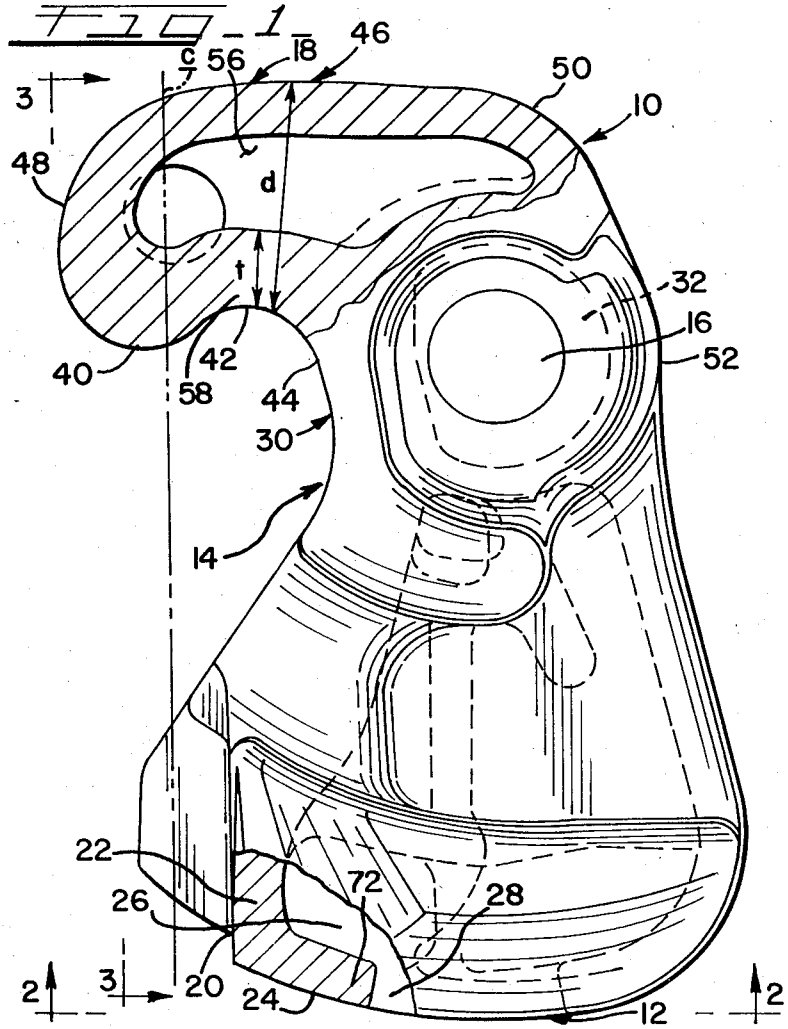
FIG. 1 is a top plan view of a coupler knuckle with the knuckle oriented in respect to the center line of a coupler body (not shown) and with some of the parts being broken away to show underlying details of structure.
Figure 4:
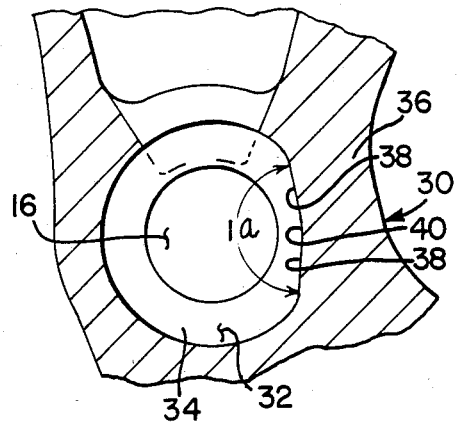
FIG. 4 is a cross sectional view taken generally along the lines 4—4 of FIG. 2.

Referring now to FIG. 1 the knuckle 10 is also formed with a throat 30 which merges with the forward portion 18. The throat 30 is located in the vicinity of the pin hole 16. The pin hole 16 as shown in FIG. 4 is formed with a round shape approximately the size of the pivot pin (not shown) at its extremities and with circumferential relief 32 in the intermediate portion. The magnitude of the circumferential relief 32 adjacent to the throat 30 causes a local reduction in the strength characteristics of the knuckle. The wall thickness 36 in the vicinity of the throat 30 is of approximately uniform thickness with a minimum thickness of at least $\frac{2}{3}$ the diameter of pin hole 16.

The forward section or portion 18 includes a nose 40 which merges into a generally ogive pulling face 42. The pulling face 42 then is connected by curved surface 44 with the throat 30. The forward or outer surface of the forward portion 18 is formed with a flat surface 46 which merges with nose 40 by a convexly curved surface 48. The opposite side of the flat surface 46 is formed with a convexly curved heel 50 which merges with a side surface 52.

Figure 3:
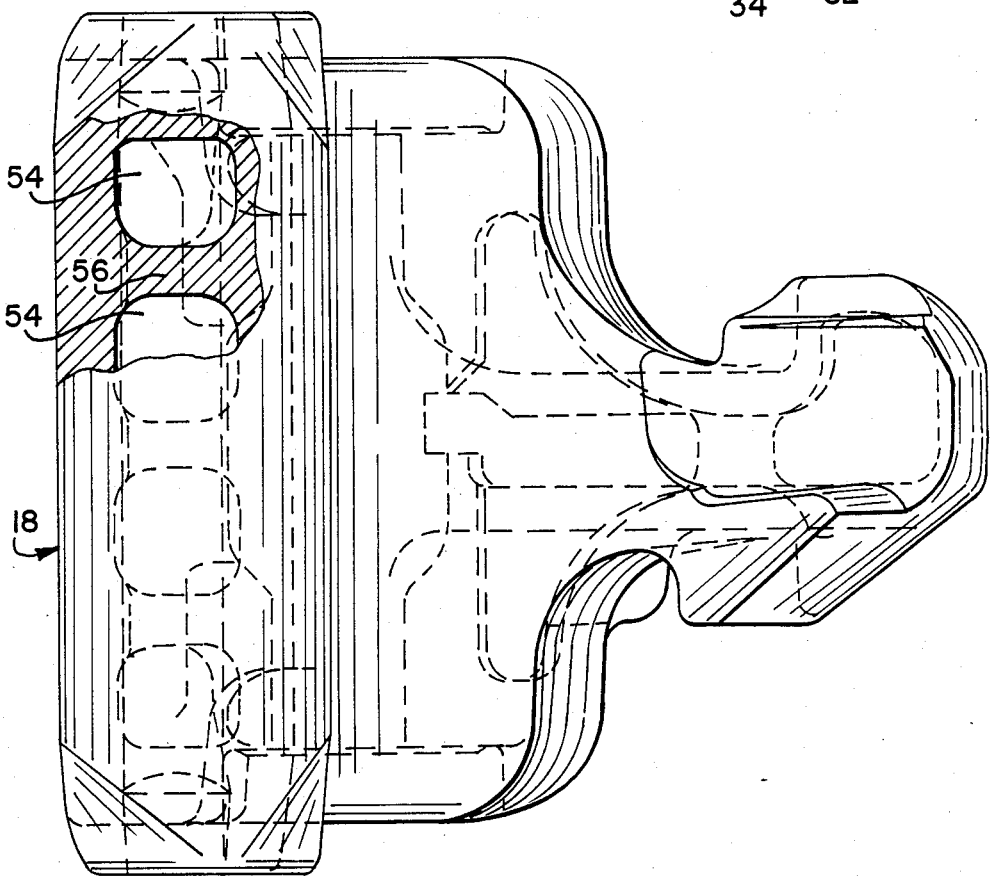
FIG. 3 is a side view of the coupler taken along the lines 3—3 of FIG. 1.

The area between the pulling face 42 and the surface 46 is provided with a cavity 54 having a plurality of spaced reinforcing ribs 56 as shown in FIGS. 1 and 3. The pulling face 42 coacts with the pulling face of an interengaging coupler and is subject to a high magnitude of stresses. In order to assure that such stresses do not result in failure of the knuckle in this area the thickness t of the wall 58 at the pulling face 42 is maintained a thickness not less than $\frac{1}{3}$ the distance d between the forward surface 46 and the pulling face 42.

At the same time the surfaces of the pulling faces 42, nose 40 and the forward planar surface 46 and the surfaces associated therewith are maintaining substantially vertical for the full width of the knuckle so as to be devoid of any draft angles as heretofore. With this arrangement of maintaining inner and outer surfaces vertical and the wall thickness uniformly in a relationship of $t=\frac{1}{3}d$ for the height of the knuckle, the concentration of forces on the pulling face is minimized and the efficient transmission of forces to the throat 30 are maximized.

What is claimed is:

1. A railway vehicle coupler knuckle comprising a steel casting formed to provide an open cored rear tail portion having a locking face wall and partial rear wall reinforcing web normal to said locking face, an intermediate section including a throat wall and a pin hole, and a forward portion including a nose surface and a curved pulling face devoid of draft angles merging with said throat, and a forward surface substantially uniformly spaced from said pulling face along the full length of the knuckle, said rear tail portion being formed with a cavity defining the inner surface of said locking face wall and said reinforcing web and a lightening hole which defines the extent of the edge of said reinforcing web from said locking wall face of at least two multiples of thickness of the locking face wall, said pin hole having end portions proximate the size of the knuckle pin and an enlarged intermediate portion spaced from said throat such that the minimum throat wall thickness is at least $\frac{2}{3}$ the diameter of the pin.

* * * * *